US007318298B2

(12) United States Patent
Marsden et al.

(10) Patent No.: US 7,318,298 B2
(45) Date of Patent: Jan. 15, 2008

(54) ILLUMINATED SECURITY GATE UNIT

(75) Inventors: Andrew W. Marsden, Hingham, MA (US); Richard M. Bastien, Cumberland, RI (US); Robert D. Monahan, Norwell, MA (US); Trung Phung, Roslindale, MA (US)

(73) Assignee: Cosco Management, Inc., Wilmington, DE (US)

( * ) Notice: Subject to any disclaimer, the term of this patent is extended or adjusted under 35 U.S.C. 154(b) by 81 days.

(21) Appl. No.: 11/130,640

(22) Filed: May 16, 2005

(65) Prior Publication Data

US 2006/0092378 A1 May 4, 2006

Related U.S. Application Data

(60) Provisional application No. 60/623,626, filed on Oct. 29, 2004.

(51) Int. Cl.
*E06B 9/01* (2006.01)

(52) U.S. Cl. ..... 49/57; 49/50; 49/463; 362/152

(58) Field of Classification Search ..... 49/50, 49/55, 56, 57, 463; 362/145, 147, 152, 276, 362/802

See application file for complete search history.

(56) References Cited

U.S. PATENT DOCUMENTS

| | | | | |
|---|---|---|---|---|
| 1,314,513 | A | | 9/1919 | Donahue |
| 1,609,055 | A | | 11/1926 | Booth |
| 1,831,052 | A | | 11/1931 | Weichelt |
| 2,277,784 | A | | 3/1942 | Schlemmer et al. |
| 2,512,954 | A | | 6/1950 | Marks |
| 3,203,052 | A | | 8/1965 | Curtis, Jr. |
| 3,867,621 | A | | 2/1975 | Gewfrtz et al. |
| 4,204,196 | A | | 5/1980 | Svada |
| 4,349,748 | A | | 9/1982 | Goldstein et al. |
| 4,400,696 | A | | 8/1983 | Klingensmith |
| 4,422,068 | A | | 12/1983 | Helft et al. |
| 4,427,975 | A | | 1/1984 | Kinzie |
| 4,520,592 | A | | 6/1985 | Holloway |
| 4,565,029 | A | * | 1/1986 | Kornbrekke et al. ..... 49/25 |
| 4,716,402 | A | | 12/1987 | Francis |
| 4,763,937 | A | | 8/1988 | Sittnick, Jr. et al. |
| 4,808,974 | A | | 2/1989 | Cantley |
| 4,851,814 | A | | 7/1989 | Rehberg |
| 4,872,095 | A | * | 10/1989 | Dubak et al. ..... 362/100 |
| 4,884,614 | A | * | 12/1989 | Spurling ..... 160/225 |
| 5,052,461 | A | | 10/1991 | Stern |
| 5,056,262 | A | | 10/1991 | Schweiss et al. |
| 5,063,372 | A | | 11/1991 | Gillett |
| 5,065,136 | A | | 11/1991 | Frolov et al. |
| 5,179,325 | A | | 1/1993 | Aragon, Jr. |
| 5,243,325 | A | | 9/1993 | Marin et al. |
| 5,272,840 | A | | 12/1993 | Knoedler et al. |
| 5,282,337 | A | | 2/1994 | Duhame et al. |
| 5,367,829 | A | | 11/1994 | Crossley et al. |
| 5,396,732 | A | | 3/1995 | Andersen |

(Continued)

*Primary Examiner*—Gregory J. Strimbu
(74) *Attorney, Agent, or Firm*—Barnes & Thornburg LLP

(57) ABSTRACT

A gate assembly comprising a gate mount and a gate mounted for movement on the gate mount between an opened position and a closed position. The gate assembly further comprises an illumination system mounted on the gate mount for turning on a light mounted on the gate mount when someone approaches the gate when it is dark in the vicinity of the gate.

13 Claims, 7 Drawing Sheets

U.S. PATENT DOCUMENTS 5,437,115 A 8/1995 Freese et al.
5,442,881 A 8/1995 Asbach et al.
5,455,564 A * 10/1995 Hsiao ..... 340/567
5,457,914 A 10/1995 Johnson, Jr.
5,488,195 A 1/1996 Mickel
5,499,171 A * 3/1996 Simpson et al. ..... 362/100
5,532,560 A 7/1996 Element et al.
5,535,552 A 7/1996 Stern
5,568,123 A 10/1996 Derheim
5,594,428 A 1/1997 Peterson
5,673,022 A * 9/1997 Patel ..... 340/565
5,680,094 A 10/1997 Guim et al.
5,686,890 A 11/1997 Ko
5,782,036 A 7/1998 Bertieri et al.
5,782,039 A 7/1998 Scherer et al.
5,809,694 A 9/1998 Postans
5,867,099 A 2/1999 Keeter
5,867,107 A 2/1999 Gartner
5,887,856 A 3/1999 Everly, II
5,924,242 A 7/1999 Macari et al.
6,021,177 A * 2/2000 Allport ..... 379/48
6,035,676 A 3/2000 Hudspeth
6,049,276 A 4/2000 Agozzino
6,079,157 A 6/2000 Hincher, Sr.
6,112,461 A 9/2000 Cheng
6,114,963 A * 9/2000 Blake et al. ..... 340/573.4
6,176,042 B1 1/2001 Rossman et al.
6,278,366 B1 8/2001 Fletcher et al.
6,292,100 B1 9/2001 Dowling
6,347,486 B1 2/2002 Badillet
6,427,383 B1 8/2002 Brooks et al.
6,454,324 B1 9/2002 Lewis et al.
6,499,254 B2 12/2002 Rossman et al.
6,516,568 B2 2/2003 Yang
6,536,163 B1 3/2003 Monahan et al.
6,536,502 B2 3/2003 Britto et al.
6,691,467 B2 2/2004 Hincher, Sr.
6,711,857 B1 * 3/2004 Wagnitz et al. ..... 49/394
2001/0000556 A1 5/2001 Rossman et al.
2002/0194786 A1 * 12/2002 Hincher, Sr. ..... 49/463
2003/0009945 A1 1/2003 Cheng
2003/0197164 A1 * 10/2003 Monahan et al. ..... 256/24
2005/0185113 A1 * 8/2005 Weindorf et al. ..... 349/71

* cited by examiner

ILLUMINATED SECURITY GATE UNIT

This application claims priority under 35 U.S.C. § 119(e) to U.S. Provisional Application Ser. No. 60/623,626, filed Oct. 29, 2004, which is expressly incorporated by reference herein.

BACKGROUND

The present disclosure relates to security gates and, in particular, to juvenile gates for use inside a dwelling. More particularly, the present disclosure relates to lighting systems for gates.

SUMMARY

An illuminated security gate unit in accordance with the present disclosure includes a gate mount, a gate coupled to the gate mount for movement between an opened position and a closed position, and an illumination system associated with the gate mount. The illumination system includes means for turning on a light coupled to the gate mount to illuminate a latch included in the gate unit and a user "navigation area" around the gate as someone approaches the gate unit when it is dark.

In illustrative embodiments, the illumination system includes a light source, a motion sensor, and a photo (light) sensor. In use, the motion sensor will turn on the light source whenever a person enters a navigation area around the gate unit established by the motion sensor as long as a signal is generated by the photo sensor to confirm that the navigation area is "dark enough" and that the light source should be turned on to illuminate the navigation area.

BRIEF DESCRIPTION OF THE DRAWINGS

The detailed description particularly refers to the accompanying figures in which.

DETAILED DESCRIPTION

Figure 1:
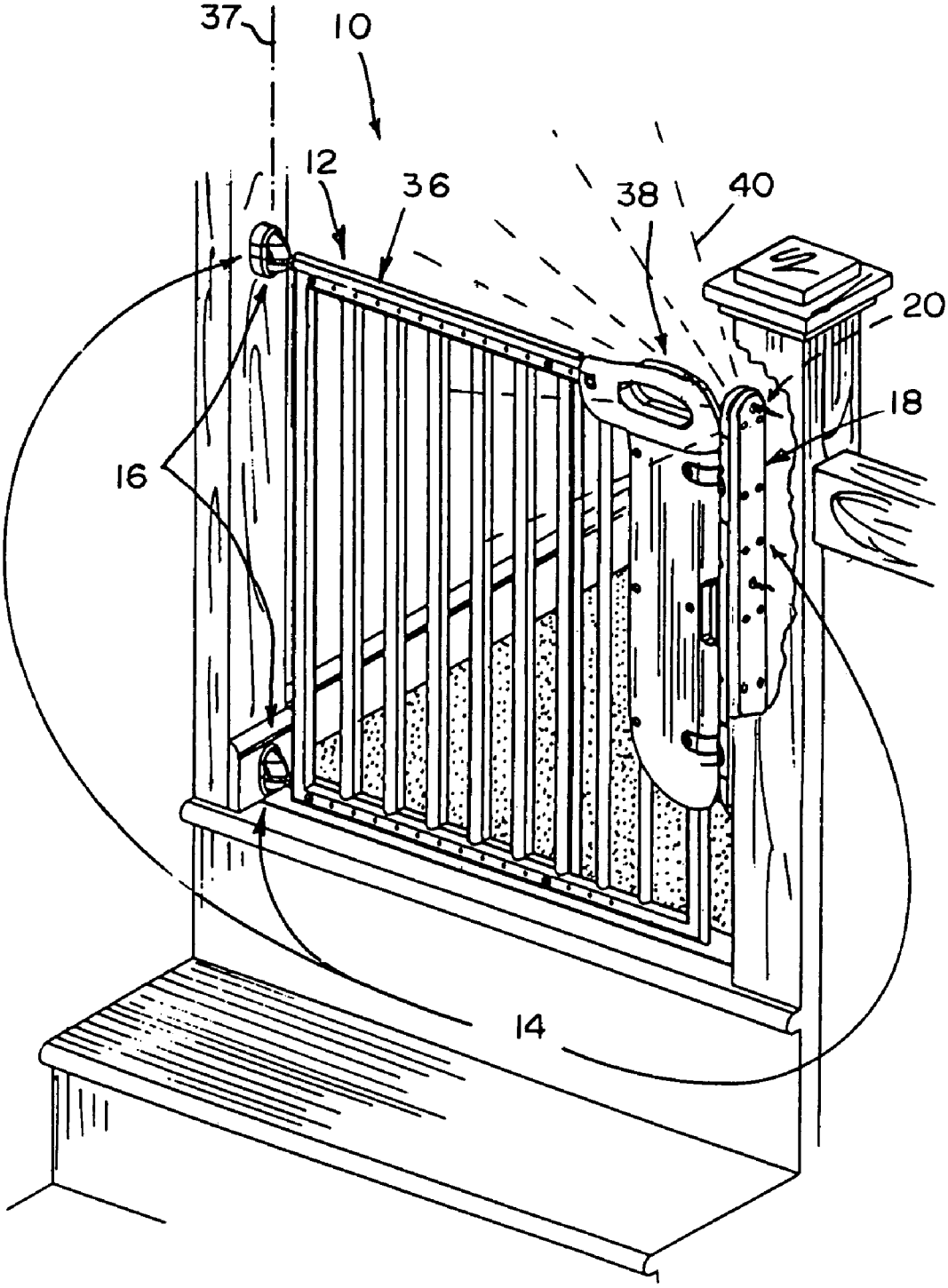
FIG. 1 is a perspective view of an illuminated security gate unit in accordance with the present disclosure showing a gate coupled to a gate mount located, for example, in a passageway of a staircase and an illumination system provided for turning on a light coupled to the gate mount when someone walks near the gate when it is dark.
Figure 2:
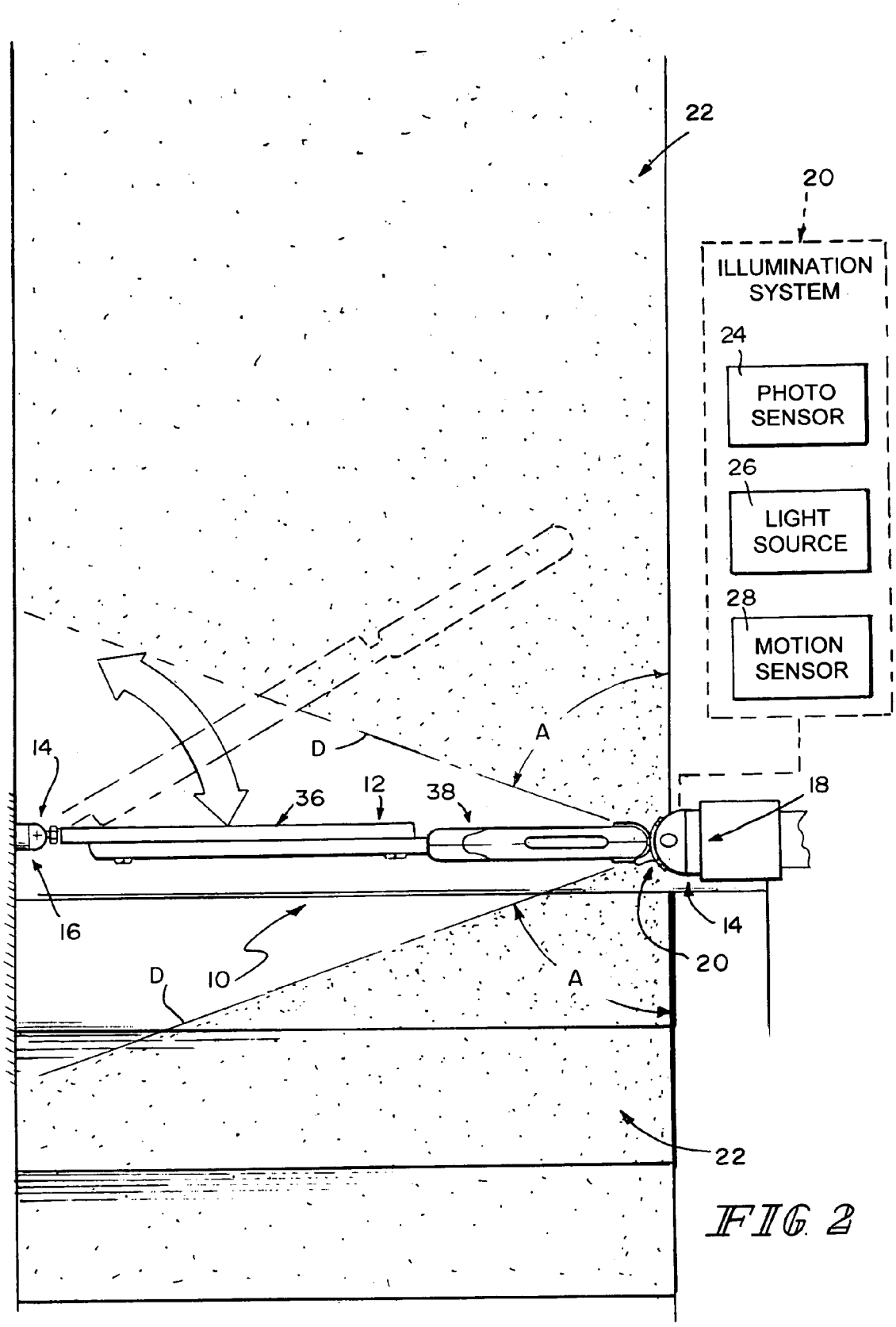
FIG. 2 is a top plan view of the gate unit showing a gate mounted to pivot between an opened position (in phantom) and a closed position (in solid) on a left-side pivot frame included in the gate mount and to mate with a right-side latch receiver frame also included in the gate mount, showing an illumination system associated with the gate mount and configured to include a motion sensor, light source, and photo sensor and showing illustrative motion-detection zones (represented by dotted patterns) established by the motion sensor on either side of the gate.
Figure 3:
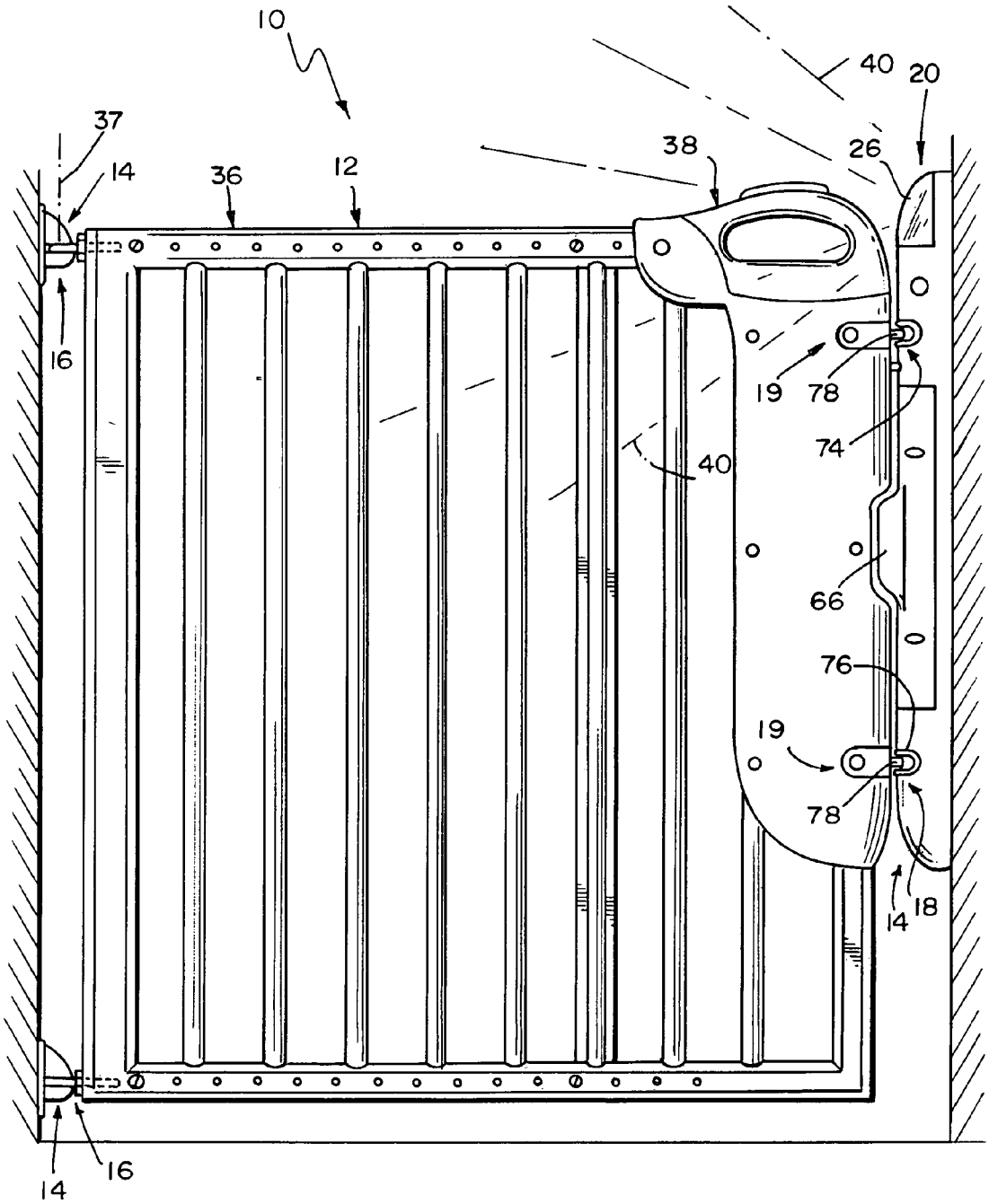
FIG. 3 is an enlarged front elevation view of the gate unit of FIGS. 1 and 2 showing a light source provided in a top portion of the right-side latch receiver frame and illuminated to shine light into a navigation area around the gate unit in a manner also shown in FIG. 5 and showing a hand-operated latch assembly coupled to a fence to define the gate and arranged to mate with the right-side latch receiver frame to retain the gate in the closed position relative to the gate mount.

An illuminated security gate unit or assembly 10 includes a gate 12 and a gate mount 14 comprising a pivot support frame 16 on a left side of gate 12 and a latch receiver frame 18 on a right side of gate 12 as shown in FIGS. 1-3. Latch receiver frame 18 is adapted to receive and mate with a latch 19 included in gate 12 to retain gate 12 in a closed position. Gate unit 10 also includes an illumination system or lighting device 20 as suggested in FIGS. 2, 3, and 8 for illuminating an otherwise darkened navigation area 21 around gate 12 and/or gate mount 14 whenever motion is detected in a motion-detection zone 22 established around gate unit 10 as suggested, for example, in FIGS. 3, 4 and 5.

Figure 8:
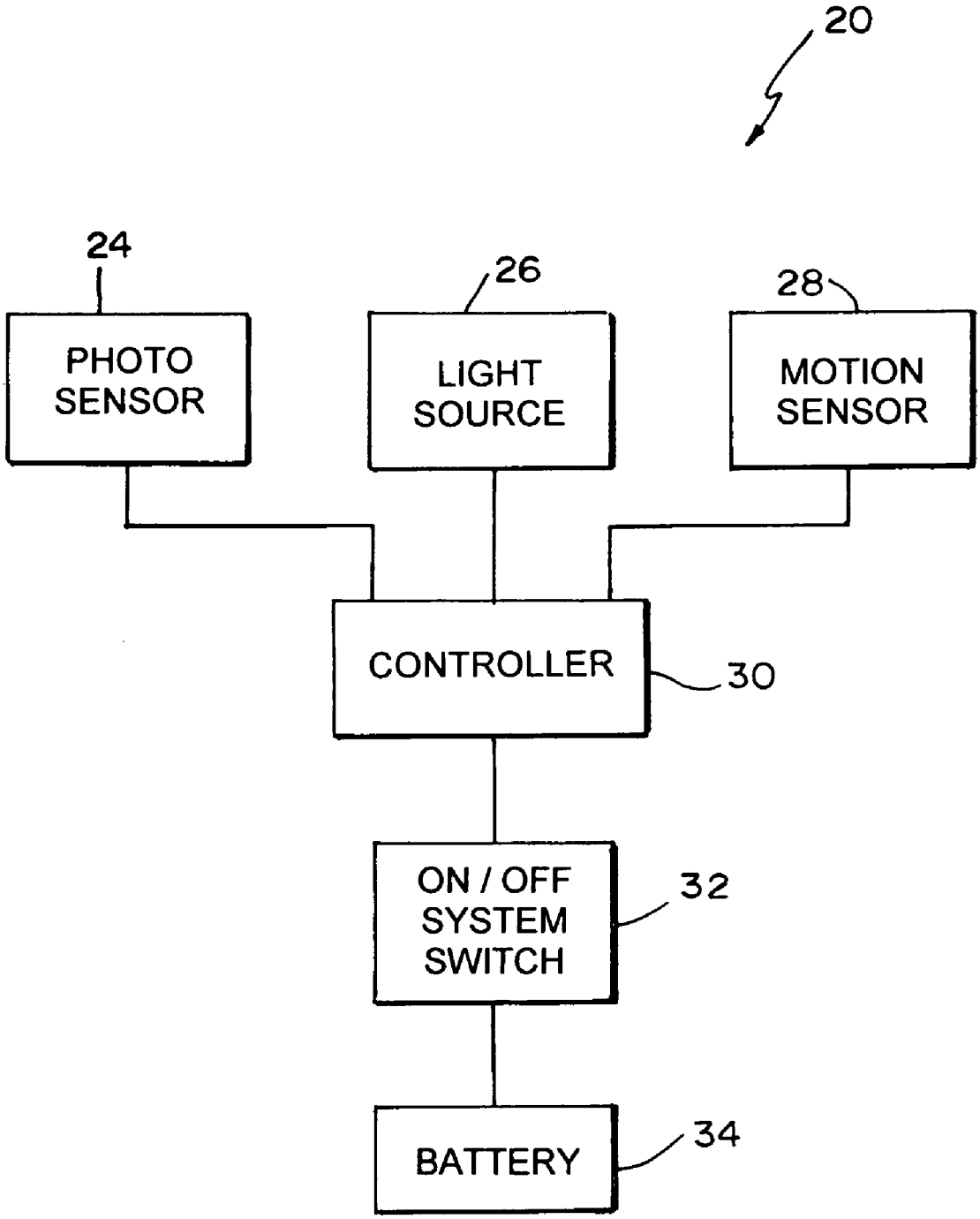
FIG. 8 is a block diagram showing components included in the illumination system in accordance with the present disclosure.

As suggested diagrammatically in FIG. 8, illumination system 20 includes a photo sensor 24, light source 26, motion sensor 28, controller 30, on/off system switch 32, and power supply (e.g., battery) 34. In an illustrative embodiment, illumination system 20 is coupled to gate mount 14, and, in particular, to latch receiver frame 18. In such an embodiment, illumination system 20 can operate to illuminate the darkened navigation area 21 around latch receiver frame 18 even if gate 12 has been removed and discarded. It is contemplated that a family may elect to remove gate 12 once the kids grow up yet leave latch receiver frame 18 in place (for example, on a wall or staircase) so that illumination system 20 coupled to frame 18 will continue to illuminate darkened navigation area 21 around latch receiver frame 18 whenever movement is detected by motion sensor 20 and a darkness condition is detected by photo sensor 24. With the motion sensors 28 mounted on the gate mount 14, which gate mount 14 is in a essentially fixed position, the motion sensors 28 monitor a predetermined area and are not dependent on the position of the gate 12 or if the gate 12 is not mounted on the gate mount 14 at all. Thus the motion sensors 28 would detect a person in the motion-detection zone 22 regardless of whether the gate 12 is in an opened or closed position or not mounted on the gate mount 14. The darkness condition is a predetermined amount of light in the darkened navigation area. Such predetermined amount of light or degree of darkness will be set as a value in the photo sensor 24, and may be adjustable.

As suggested in FIG. 3, gate 12 includes a fence 36 coupled to pivot support frame 16 for pivotable motion about a vertical pivot axis 37 and a hand-operated latch assembly 38 including spring-biased upper and lower latches 19 arranged to mate with latch receiver frame 18 upon movement of gate 12 to the closed position. Each latch 19 includes a plunger post 39 that is movable to extend into one of post receivers 41 formed in latch receiver frame 18, as suggested in FIG. 3 to retain gate 12 in the closed position. It is within the scope of this disclosure to employ any suitable latching mechanism to retain gate 12 in a closed position relative to gate mount 14.

Figure 4:
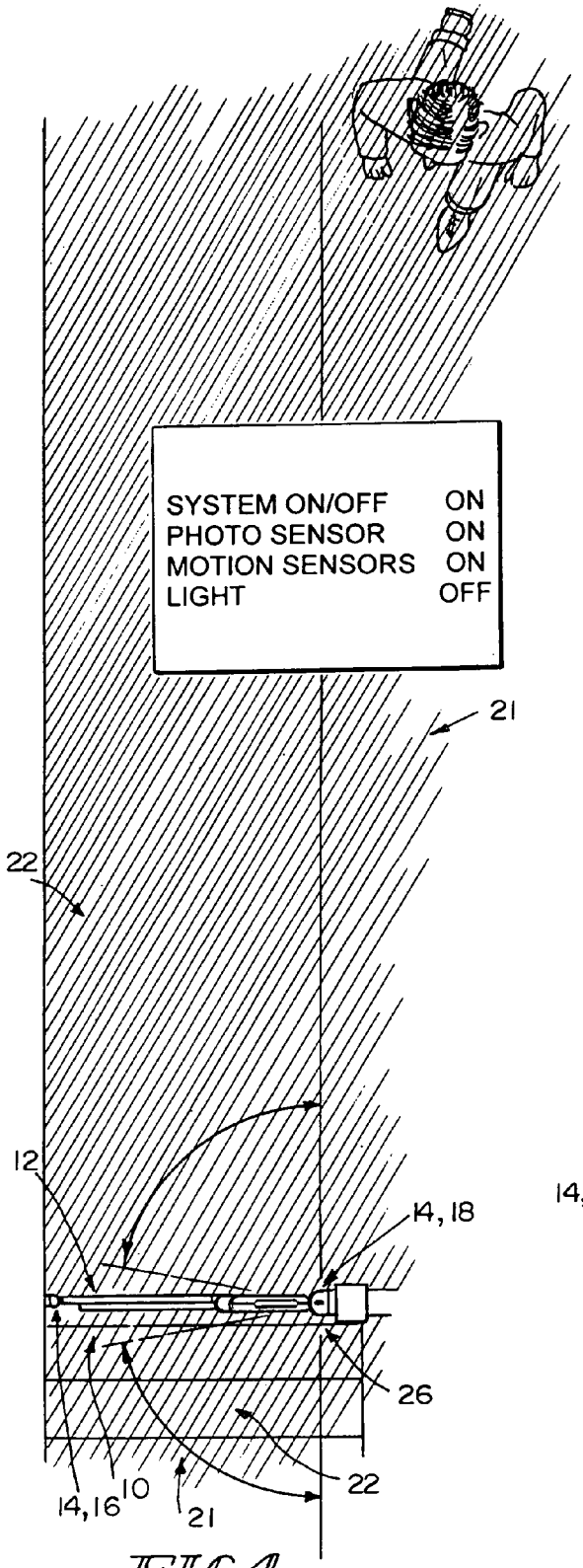
FIG. 4 is a "birds-eye" view of the gate unit, stairs, and hallway of FIG. 1 in a "darkened" condition (represented by diagonal lines) before the light source in the illumination system is turned on and showing a person approaching a motion-detection zone associated with the illumination system included in the gate unit and indicating diagrammatically an operating status of the illumination system and components included in the illumination system.

As suggested in FIG. 4, light source 26 included in illumination system 20 remains turned off in darkened navigation area 21 around gate unit 10 so long as motion sensor 28 fails to sense motion in a motion-detection zone 22 around gate unit 10 established by motion sensor 28. At this stage, photo sensor 24 is "on" to sense and distinguish between "lightness" and "darkness" in navigation area 21. Light source 26 will be turned on by the controller 30 to illuminate navigation area 21 in response to the motion sensor 28 detecting motion in the motion-detection zone 22 only when photo sensor 24 senses a darkness condition in navigation area 21.

Motion-detection zone 22, as shown, for example, in FIG. 2, may include a zone represented by arcs or angles A covering angles of approximately 80° and distances of approximately ten feet, represented by lines D. The angles A and distances D are measured generally from a point at a top end of latch receiver frame 18 and also extend vertically above latch receiver frame 18. Motion-detection zone 22 is established relative to latch receiver frame 18 whether or not gate 12 is mounted on gate mount 14.

Figure 5:
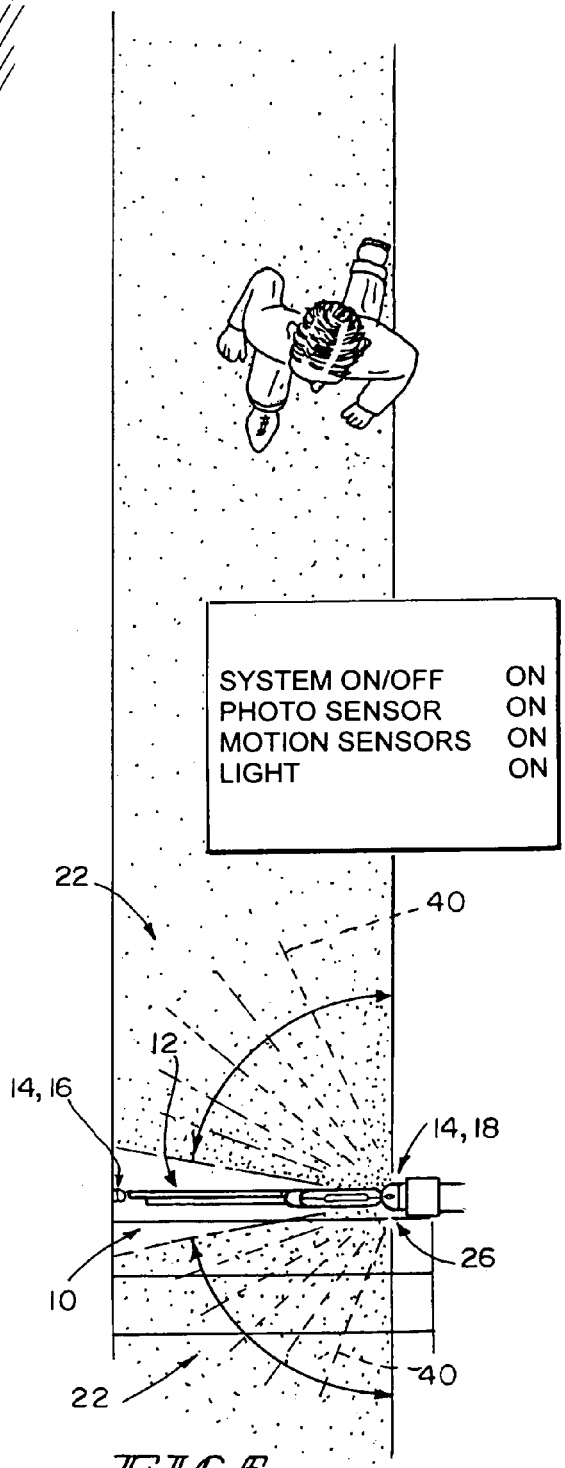
FIG. 5 is a view similar to FIG. 4 showing movement of the person of FIG. 4 into the motion-detection zone established by the motion sensor and showing illumination of an illumination area around the gate unit by the light source coupled to the right-side latch receiver frame in response to illumination signals provided by the motion sensor (sensing motion in the motion-detection zone as suggested in FIG. 5) and the photo sensor (sensing darkness in the navigation area around the gate unit as suggested in FIG. 4)

As suggested in FIG. 5, a person shown in FIG. 4 has now moved to enter motion-detection zone 22 (represented by a dot pattern) and stimulated motion sensor 28 to provide a motion-sensing signal to controller 30 in illumination system 20. Because of the darkness in the navigation area 21 shown in FIG. 4, photo sensor 24 is stimulated to provide a darkness-sensing signal to controller 30. Controller 30 in turn operates to turn on light source 26 and generate/shine light 40 (represented by dotted ray lines) in navigation area 21.

Figure 6:
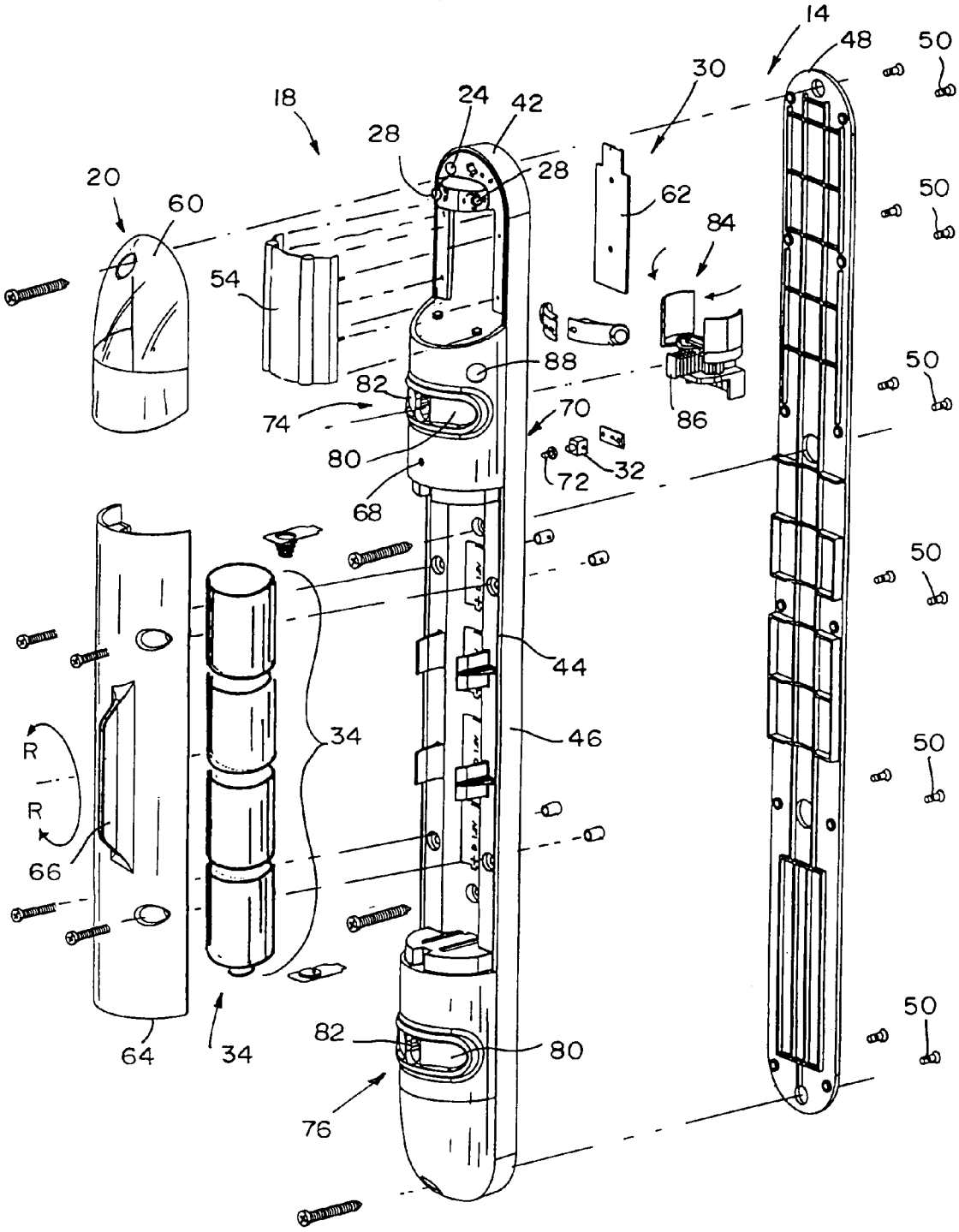
FIG. 6 is an exploded perspective view of components included in the right-side latch receiver frame.
Figure 7:
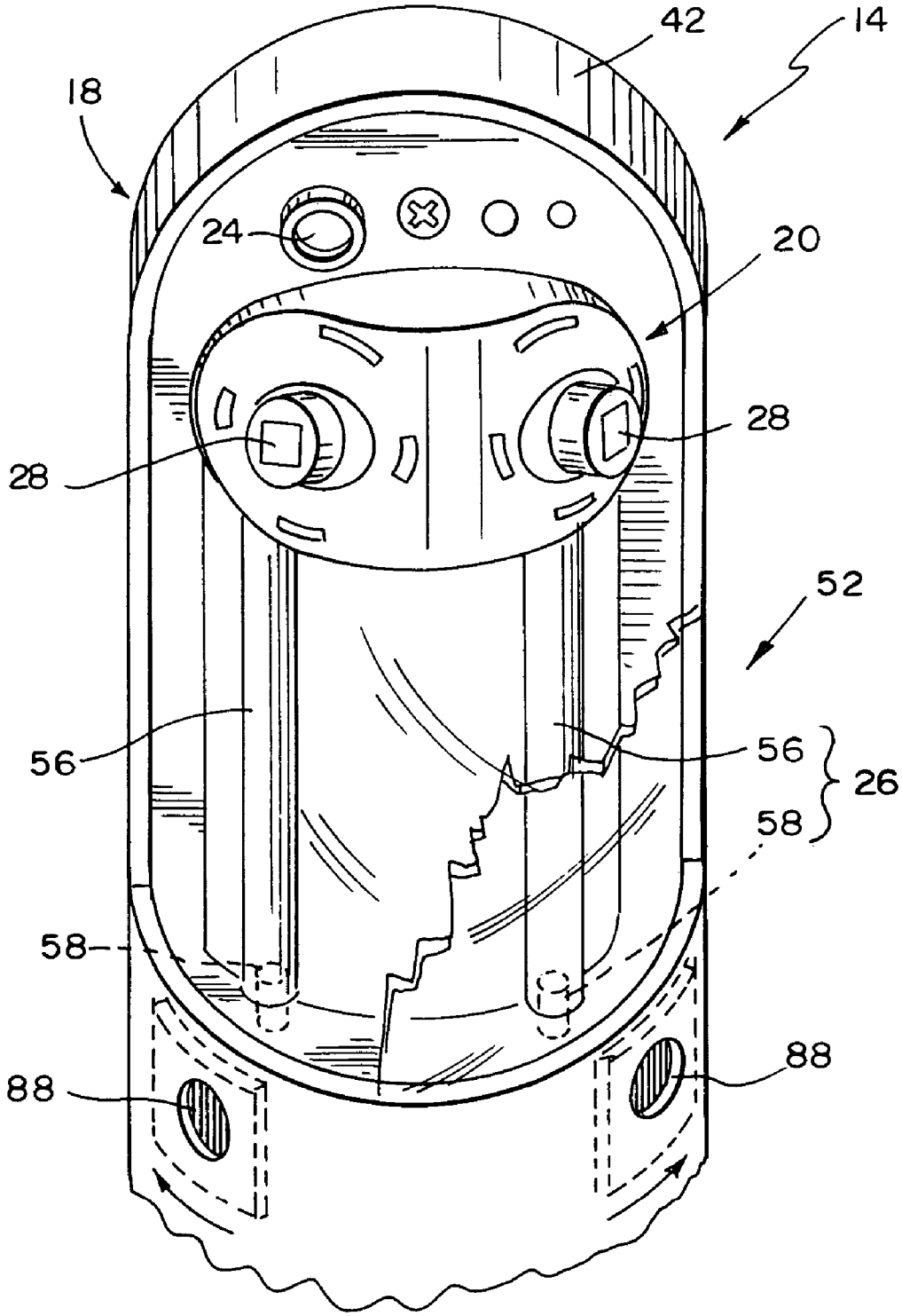
FIG. 7 is an enlarged front elevation view of the top portion of the right-side latch receiver frame included in the gate mount showing the photo sensor, motion sensor, and light source.

Components of illumination system or lighting device 20 and latch receiver frame 18 of gate mount 14 are best seen in FIGS. 6-7. Latch receiver frame 18 includes housing 42, having a front side 44 and a rear side 46, and housing cover 48. Housing 42 and housing cover 48 are connected together by, for example, screws 50 and configured to include components of illumination system 20. Illumination system 20 includes photo sensor 24, motion sensors 28 and light source 26 mounted on an upper portion 52 of latch receiver frame 18. Light source 26 includes, for example, a light diffuser 54 having, for example, two light pipes 56 incorporated therein. Light source 26 also includes, for example, two light-emitting diodes or LEDs 58, with each LED 58 at least partially enclosed in one of the light pipes 56. The photo sensor 24, motion sensors 28 and light source 26 are enclosed by a lens 60 connected to front side 44 of housing 42, as suggested in FIG. 6. Controller 30, shown diagrammatically in FIG. 7, is included, for example, on printed circuit board 62 located between and enclosed by rear side 46 of housing 42 and housing cover 48, as suggested in FIG. 6.

Illumination system 20 also includes power supply 34, shown diagrammatically in FIG. 7 and further shown, for example, as four batteries in FIG. 6. The low-battery indicator is when battery power activated, for example, has approximately seven days or less of available power. When the controller 30 senses a low power situation, the LEDs 58 will flash at a specified rate for a predetermined period of time, for example, seven flashes at approximately one second per flash for approximately several minutes. The LEDs 58 will then be turned off. That cycle of flashes may be repeated periodically. The low-power indicator may be operative whether the system switch 32 is on or not. If, however, the power switch 32 has been turned on and the LEDs 58 have been turned on by the controller 30, as previously described herein, and if a low-power condition is detected by the controller 30, the LEDs 58 will flash for the predetermined rate and for the predetermined period of time and then remain on for another predetermined period time after the last motion is detected by the motion sensors 28. Power supply 34 is enclosed on latch receiver frame 18 between front and rear sides 44, 46 of housing 42 and enclosed by a frame or power supply cover 64. Power supply cover 64 includes a gate stop 66 protruding external to power supply cover 64 toward gate 12 and configured to prevent gate 12 from advancing past gate stop 66 upon the gate 12 being swung into the closed position, as suggested in FIG. 3. Gate stop 66 is reversible, as suggested by arrows R in FIG. 6, to accommodate gate unit 10 being installed such that gate 12 opens in an opposite direction to that shown in FIG. 2.

Illumination system 20 also includes a system on/off switch 32, shown diagrammatically in FIG. 7. Switch 32 is further shown in FIG. 6 and located, for example, between front and rear sides 44, 46 of housing 42 and between upper portion 52 and power supply cover 64. Switch 32 is used to activate illumination system 20. That is, when switch 32 is put in the "on" position, photo sensor 24 and motion sensors 28 are activated via controller 30 and placed in condition to detect a darkness in the navigation area 21, condition and movement, in the motion-detection zone 22 respectively. It is within the scope of this disclosure that the photo sensor 24 and motion sensors 28 would be turned on in sequence. That is, when switch 32 is put in the "on" position, photo sensor 24 is turned on and when a darkness condition is detected in the navigation area 21, the motion sensors 28 are turned on. When motion sensors 28 detect motion in the motion-detection zone 22, controller 30 turns on light source 26 which shines light 40 over motion-detection zone 22.

Light source 26 is connected to a timing element (not shown) which may be part of controller 30. Such timing element can be set to maintain light source 26 in an "on" condition for a predetermined or specified period of time such as, for example, from several seconds to several minutes after the last motion is detected by motion sensors 28. Light source 26 may, for example, generate light 40 to a power of, for example, 100-500 LUX. Front side 44 includes an opening 68 to a cavity 70 in housing 42, the opening 68 configured to accommodate a button 72 of switch 32. Switch 32 may be in a recessed position in opening 68 such that a user must insert a device, such as a pin or point of a pen, in order to manipulate or depress the button 72 to turn the illumination system 20 on or off. Such an arrangement is designed to prevent an undesired turning on or off of illumination system 20 by an unauthorized person, such as, for example, a child.

Latch receiver frame 18 also includes upper and lower post receivers 74, 76, respectively, configured to receive and mate with plunger posts 78 of gate 12 to retain gate 12 in the closed position, as suggested in FIG. 3. As shown in FIG. 6, post receivers 74, 76 include ramps 80 and openings 82 configured to guide and receive plunger posts 78 when gate 12 is moved toward and into the closed position. A gate lock indicator assembly 84 is also included in latch receiver frame 18 and located, for example, behind upper post receiver 74, as suggested in FIG. 6. Gate lock indicator assembly 84 includes a plunger mechanism 86 configured to be depressed by plunger post 78 penetrating upper post receiver 74 when plunger post 78 penetrates opening 82, and to be released when plunger post 78 is withdrawn from opening 82. Gate lock indicator assembly 84 also includes viewing windows 88 on front side 44 which, for example, display color indicators reflecting whether the gate is in a locked or unlocked status (i.e., "green" is displayed for locked and "red" is displayed for unlocked). That is, when plunger post 78 has penetrated opening 82 of upper post receiver 74 and depressed plunger mechanism 86, viewing windows 88 will display a green indication. When plunger post 78 is withdrawn, viewing windows 88 will display a red indication.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A gate assembly for use in a dwelling, the gate assembly comprising a gate mount configured to be mounted to a portion of the dwelling, a gate swingably mounted on a portion of the gate mount for movement between an opened position and a closed position and, a lighting device mounted in the gate mount, the lighting device including a photo sensor configured to detect a darkness condition inside the dwelling, a motion sensor which detects motion in motion-detection zones extending from and which detects beyond both sides of the gate and the gate mount, a light source, and a controller which turns on the light source for illuminating a darkened navigation area in the dwelling when both the darkness condition is sensed by the photo sensor and the motion sensor detects motion in at least one of the motion-detection zones, the darkened navigation area extending from and beyond the gate and the gate mount.

2. The gate assembly of claim 1, wherein the gate mount includes a pivot support frame configured to be coupled to a first side of the gate and a latch receiver frame configured to mate with a latch on a second side of the gate.

3. The gate assembly of claim 2, wherein the lighting device is mounted in the latch receiver frame.

4. The gate assembly of claim 3, wherein when the gate is not mounted on the gate mount, the lighting device operates to turn on the light source when both said darkness condition is sensed by the photo sensor and the motion sensor detects motion in said at least one of said motion-detection zones.

5. The gate assembly of claim 1, wherein the darkness condition is a predetermined amount of light in the darkened navigation area around at least one of the gate mount and the gate.

6. The gate assembly of claim 5, wherein the photo sensor, motion sensor, and light source are connected to the controller, and when the photo sensor detects the darkness condition, the photo sensor sends a darkness-sensing signal to the controller whereby the controller turns on the motion sensor.

7. The gate assembly of claim 6, wherein when the motion sensor detects motion in said at least one of said motion-detection zones, the motion sensor sends a motion-sensing signal to the controller to cause the controller to turn on the light source.

8. A gate assembly for use in a dwelling, the gate assembly comprising a gate mount configured to be mounted to a portion of the dwelling, a gate swingably mounted on a portion of the gate mount for movement between an opened position and a closed position, a lighting device mounted in the gate mount, the lighting device including a photo sensor configured to detect a darkness condition inside the dwelling, a motion sensor which detects motion in motion-detection zones extending from and beyond both sides of the gate and the gate mount, a light source, and a controller which turns on the light source for illuminating a darkened navigation area in the dwelling when both the darkness condition is sensed by the photo sensor and the motion sensor detects motion in at least one of the motion-detection zones, the darkened navigation area extending from and beyond the gate and the gate mount, and wherein the light source includes a power source and when the controller detects a predetermined power source value indicating a low-power condition in said power source, the light source is turned on and flashes at a predetermined rate for first predetermined period of time.

9. The gate assembly of claim 8, wherein when the controller detects the predetermined power source value indicating said low power condition, and the motion sensor has detected motion in said at least one of said motion-detection zones, the light source is turned on and flashes at said predetermined rate for the first predetermined period of time after which the light source remains on for a second predetermined period of time after the last motion is detected by the motion sensor.

10. The gate assembly of claim 8, wherein the light source remains turned on for a second predetermined period of time after the first predetermined period of time has expired and the last motion is detected by the motion sensor.

11. The gate assembly of claim 8, wherein the light source is off so long as the motion sensor fails to detect motion in the motion-detection zones.

12. The gate assembly of claim 8, wherein the light source includes at least one LED and a light diffuser and the light diffuser includes at least one light pipe to at least partially enclose the at least one LED.

13. The gate assembly of claim 8, wherein the gate mount includes a latch receiver portion configured to mate with a latch on the gate to retain the gate in the closed position.

* * * * *